US005485712A

United States Patent [19]

Cherney et al.

[11] Patent Number: 5,485,712

[45] Date of Patent: Jan. 23, 1996

[54] METHOD OF HANDLING FILM ON A VERTICAL FORM, FILL AND SEAL MACHINE

[75] Inventors: Dale M. Cherney, Howards Grove; Keith Hopkins, Sheboygan, both of Wis.

[73] Assignee: Hayssen Manufacturing Company, Sheboygan, Wis.

[21] Appl. No.: 379,849

[22] Filed: Jan. 27, 1995

[51] Int. Cl.[6] ..... B65B 9/20; B65B 1/22; B65B 1/24

[52] U.S. Cl. ..... 53/436; 53/437; 53/451; 53/55; 53/525; 53/526; 53/552

[58] Field of Search ..... 53/436, 437, 451, 53/55, 523, 525, 551, 552, 389.4, 389.5, 526

[56] References Cited

U.S. PATENT DOCUMENTS

| | | | |
|---|---|---|---|
| 3,027,695 | 4/1962 | Leasure | 53/552 X |
| 3,525,193 | 8/1970 | Cutler et al. | 53/437 |
| 3,668,815 | 6/1972 | Henry et al. | 53/437 |
| 4,288,965 | 9/1981 | James | 53/451 |
| 4,391,081 | 7/1983 | Kovacs | 53/436 |
| 4,546,596 | 10/1985 | Cherney | 53/551 X |
| 4,578,931 | 4/1986 | Roovers | 53/551 |
| 4,591,499 | 9/1987 | Umeda et al. | 53/551 X |
| 4,727,707 | 3/1988 | Hadden | 53/451 |
| 4,965,986 | 10/1990 | Klinkel | 53/551 |
| 5,377,474 | 1/1995 | Kovacs et al. | 53/451 X |
| 5,388,387 | 2/1995 | McElvy | 53/451 |

*Primary Examiner*—Horace M. Culver

*Attorney, Agent, or Firm*—Lee, Mann, Smith, McWilliams, Sweeney & Ohlson

[57] ABSTRACT

A method and apparatus of maintaining tension in the film over the forming shoulder in the forward and reverse directions of a package formed in a vertical form, fill and seal machine and stripping and/or settling products out of the sealing and severing area of a partially formed package. The machine includes a source of film, a measuring axis, a forming shoulder, a pull axis, and a finishing system for stripping, sealing and severing successive packages from a formed tube. The measuring axis and the pull axis are operated in the forward direction to form a film tube while tension is maintained on the tube. After a predetermined length of tubing has been pulled, the measuring axis is operated in the reverse direction while the tube is retained in tension downstream of the forming shoulder. Stripping of product entrained in the film seal area can occur in the reverse direction. Product can also be settled in the tube by alternately operating in the forward and reverse directions, or by operating in a stepwise fashion in the forward direction as product as injected into the tube.

26 Claims, 2 Drawing Sheets

METHOD OF HANDLING FILM ON A VERTICAL FORM, FILL AND SEAL MACHINE

BACKGROUND OF THE INVENTION

This invention relates generally to vertical form, fill and seal machines, and in particular to a method and apparatus for controlling tension in the film as it passes over the forming shoulder in the forward and reverse directions, without which the film will mistrack over the forming shoulder. The invention allows stripping or settling of product out of the seal area and into a partially formed package to keep any product from contaminating a seal area of the package before the package is sealed, while permitting a high quality package to be manufactured at extremely high speeds.

U.S. Pat. No. 4,288,965 discloses a vertical form, fill and seal machine in which a measuring roll pair is used to precisely meter plastic film from a source thereof, with downstream pull belts being used in conjunction with the measuring rolls to maintain tension over the forming shoulder located between the measuring rolls and the pull belts. This patent does not consider reversing of the measuring rolls and pull belts, and does not address stripping of excess product that may exist in the formed plastic film tube in the area where sealing and severing of successive packages occurs.

Stripping of product into a package made on a vertical form, fill and seal machine has been accomplished for years in order to eliminate any product that is in the formed bag but positioned above the sealing area from contaminating the seal area as a final seal is effected. One such apparatus is set forth in U.S. Pat. No. 4,391,081, assigned to Hayssen Manufacturing Company of Sheboygan, Wisconsin. In this apparatus the product is stripped out of the sealing area and into the bag by using a pair of sliding members which engage the film above horizontally activated sealing dies before the sealing dies close. The sliding members are activated to close and then strip downwardly over the partially formed bag and through the sealing dies prior to the sealing dies closing. This apparatus provides a high quality package but is useful only at speeds below 60 packages per minute. At speeds greater than that, the time required to close and lower the sliding members and strip down is so great that it significantly increases the time required to make a package and thus inhibits productivity.

Other stripping procedures have been used over the years. One such procedure employs a stripping process using the sealing dies, in which the film tube is pulled an amount greater than one package length, the sealing mechanism is then partly closed, and the direction of the film tube is reversed by pulling it in the opposite direction to the correct package length. One version of this method is described in U.S. Pat. No. 3,027,695 assigned to Mira-Pak of Houston, Texas. As in other such systems, this system pulls the film tube to an amount greater than one package length, partially closes the sealing dies, and pulls the tube in the reverse direction through the partially closed sealing dies by moving the entire forming tube assembly in an upward direction, with the film tube therefore moving with the forming tube assembly. This system was used very successfully by the snack food industry during the 1970's. However, this system also suffers problems, including the need of operating at relatively slow speeds, a large moving mass which needs frequent maintenance, and a difficulty of threading the film into the apparatus and then maintaining a constant film tension.

Another stripping system is described in U.S. Pat. No. 4,965,986. This system provides a stripping process controlled by simply reversing the direction of the film tube after the sealing dies have been partly closed. An eccentric mechanism is used to control both the partial closure of the sealing dies as well as their full closure for sealing of the package. The film tube is pulled in a forward direction by conventional pull belts, and is pulled an amount greater than one package length. In stripping, the pull belts are used to pull the film tube in a reverse direction and an auxiliary roll upstream from the forming shoulder pulls the film back over the forming shoulder without moving the forming tube or the sealing dies.

Because some products cannot be stripped into a partially made bag, i.e. powders and fragile products such as cookies, etc., various settling devices operating in the horizontal plane have been evolved. One such device is a "tapper" which may consist of an air cylinder with a rubber bumper, a narrow plate or some other device fixed to its rod end. The cylinder rod is actuated at any time during the bag making and filling cycle, usually below the sealing and severing means and at a frequency of several hundred taps per minute. Another device consists of two rods fastened together at one end similar to a "tuning fork". This device is usually placed below the sealing and severing means with the partially made and filled bag descending through the tines. This device is oscillated horizontally to the incoming partially completed bag with a frequency of several hundred oscillations per minute and an amplitude of up to one inch in either direction. Both these devices shake the partially formed bag in the horizontal direction which in some instances causes the product to settle in the partially formed bag.

Certain products may require both a stripping device and a settling device.

SUMMARY OF THE INVENTION

The present invention provides a method and apparatus which avoids the problems of the prior art, and which can be operated at consistent, high speeds with absolute registration accuracy and maintenance of film tension. The invention employs a vertical form, fill, and seal machine, with the machine including a source of plastic film, a measuring axis for conveying the film and measuring a predetermined amount of film, a forming shoulder for forming the film into a tube, a pull axis for conveying the tube, and a finishing system for sealing and severing successive finished packages of desired length from the film tube. The method according to the invention comprises the steps of operating the measuring axis and the pull axis in a forward direction while pulling the film over the forming shoulder and maintaining the tube in tension downstream of the forming shoulder to retain tension in the film as it passes over the forming shoulder in the forward direction. After a predetermined amount of film has been pulled, the measuring axis is operated in a reverse direction while maintaining the tube in tension downstream of the forming shoulder to retain tension in the film as it passes over the forming shoulder in the reverse direction. The tube is then severed and sealed into the finished package.

In accordance with the preferred form of the invention, the process includes the further step of controlling the axes in a master/slave relationship, with one of the axes being a master, and the second of the axes being a slave. Preferably, the measuring axis is the master and the pull axis is the slave since all film registration and orientation is typically accomplished in relation to the measuring axis.

In the forward direction, the measuring axis is operated to convey the film an actual forward distance and the pull axis attempts to convey the tube a forward distance greater than the actual forward distance. In the reverse direction, the measuring axis conveys the film an actual reverse distance and pull axis attempts to convey the tube a lesser distance.

The excess of the actual forward distance in relation to the attempted forward distance, and the actual reverse distance in relation to the attempted reverse distance, depends on the characteristics of the film, its stiffness, coefficient of friction, size of the ultimate package, and apparatus involved. The film does not stretch significantly, and instead slips between the pull belts and forming the tube. Friction maintains the desired tension between the pull belts and forming tube. In one form of the invention, the attempted forward distance is up to about 5 percent greater than the actual forward distance. In this form of the invention, the attempted reverse distance is also up to about 5 percent less than the actual reverse distance.

In a preferred form of the invention, before the tube is severed and sealed into the finished package, the sealing area of a partially finished package is stripped to remove any product from contaminating the sealed area. The step of stripping includes activating the finishing system before the measuring axis is operated in the reversed direction. The finishing system includes a pair of opposite sealing dies, and is activated by partially closing the sealing dies onto the tube before its direction is reversed.

In an alternative form of the invention, settling of product occurs by shaking the tube of the partially finished package. Shaking is accomplished by operating the measuring axis and the pull belts in the reverse direction for a desired distance, then operating the measuring axis and the pull axis in the forward direction for the desired distance, and repeating the reverse and forward pulls a predetermined number of times with a predetermined frequency of repetition in order to settle product into the partially finished package before it is severed and sealed.

In another form of the invention, settling occurs by operating the measuring axis and the pull axis in the forward direction for a desired distance, and then reversing the measuring axis a distance less than the desired distance. These steps are repeated until the tube is pulled at least the desired length of the finished package. Thereafter, the tube is sealed and severed into the finished package.

In another form of the invention, the measuring axis and the pull axis are operated in the forward direction for a desired distance, and then stopped. A portion of desired product is injected into the tube while the tube is stopped. These steps are then repeated with the tube advanced and then stopped, and a portion of the desired product injected into the tube, until the tube is formed to at least the desired package length. Thereafter, the tube is sealed and severed into the finished package.

In the apparatus according to the invention, the pull axis includes a pair of pull belts, and one or more servo motors is used for driving the pull belts in synchronism with each other. A controller is connected to the servo motor to control the motor and therefore control the amount of pull by the pull belts. The measuring axis includes a pair of measuring rolls, and a servo motor is used for driving the measuring rolls. The controller is connected to the servo motor of the measuring rolls for rotating the rolls a predetermined amount. The controller is programmable to precisely control the length of film and tube conveyed in both the forward and reverse directions in order to maintain desired tension in the film at all times.

BRIEF DESCRIPTION OF THE DRAWINGS

The invention is described in greater detail in the following description of an example embodying the best mode of the invention, taken in conjunction with the drawing figures, in which.

DESCRIPTION OF EXAMPLES EMBODYING THE BEST MODE OF THE INVENTION

Figure 1:
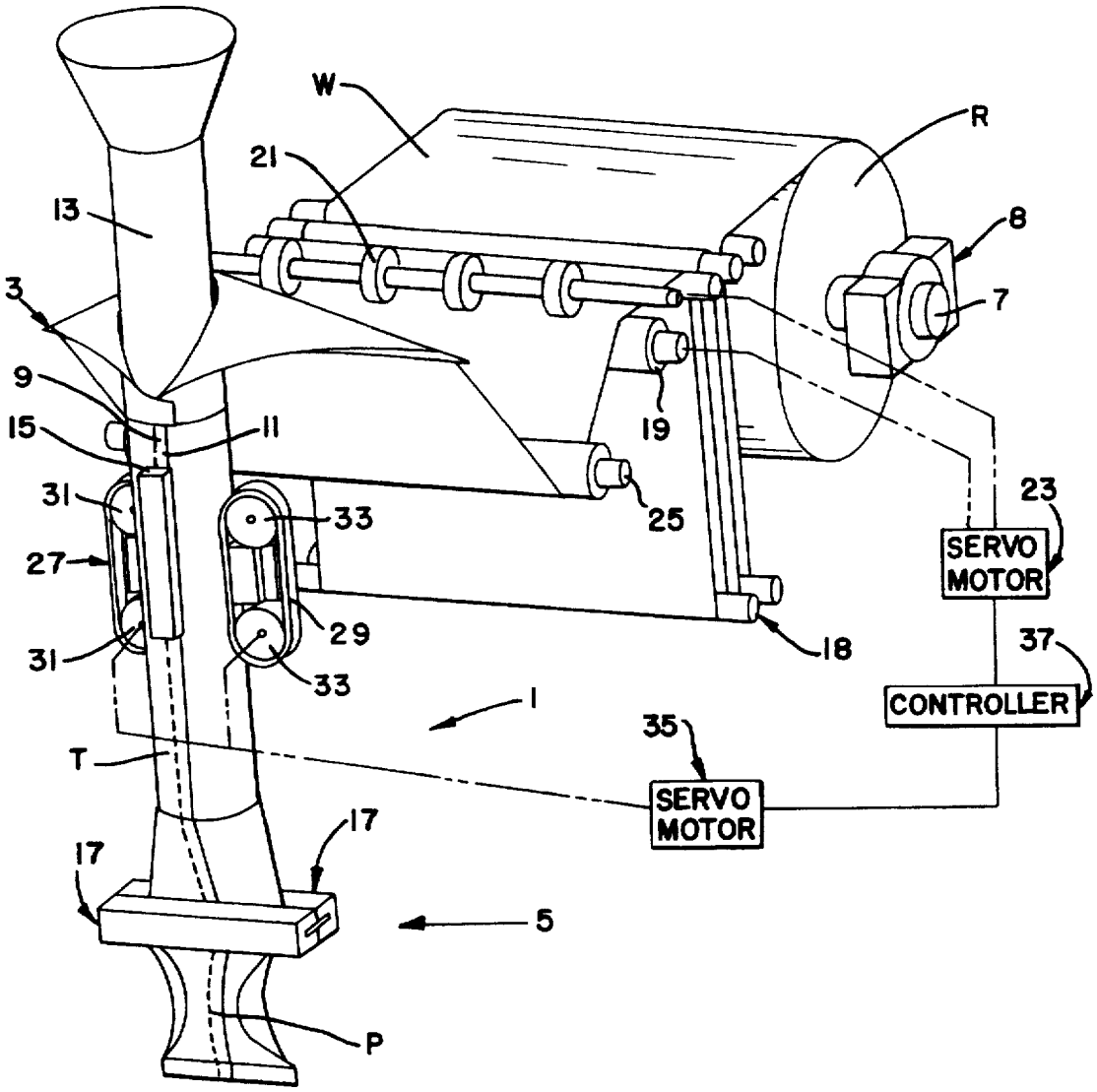
FIG. 1 is a perspective of a vertical form, fill and seal machine of the invention, illustrating the salient aspects of the invention while eliminating unnecessary conventional detail.

An apparatus according to the invention is generally depicted at 1 in FIG. 1. The apparatus may be a vertical, fill and seal machine such as that depicted and described in U.S. Pat. Nos. 4,288,965, 4,391,081 and 5,377,474, the disclosures of which are incorporated herein by reference. In the apparatus 1, a web W of flexible packaging material, such as a plastic film, is pulled from a supply R in the form of a roll, is fed over a forming shoulder 3 for forming the web into a tube T around a forming tube 13 which extends above and below the forming shoulder 3, product to be packaged is provided and inserted through the forming tube 13 into the film tube T in a conventional fashion, and sealing is then performed on the film tube T as generally indicated at a sealing apparatus 5. The roll R of film may be supported in a customary fashion with a core spindle assembly 7 which incorporates a roll brake 8. The elements of the invention described above may all be conventional, and are therefore not described in greater detail.

The forming shoulder 3 forms the web W of plastic film into the film tube T with longitudinal margins 9 and 11 of the web W in an overlapping relationship, and then directs the tubing downwardly around the vertically extending forming tube 13 which extends above and below the forming shoulder 3. A lap sealer 15, shown diagrammatically in FIG. 1, is used for sealing the overlapping margins 9 and 11 to provide a longitudinal seal in the tube T. Product is introduced into the tube T in a conventional fashion, and the tube T is then transversely sealed at desired package length intervals by the sealing apparatus 5. Preferably, the sealing apparatus 5 consists of opposite pairs of sealing dies 17, each operable in a fixed horizontal plane in order to form a top seal for the package P being completed and the bottom seal for the next package to be formed. The sealing dies 17 typically incorporate conventional cutting means for transversely severing the tube T between the seals made by the upper and lower pairs of sealing dies 17. Finally, associated with or a part of the sealing dies are appropriate means for stripping entrained product in the sealing area of the film tube, such as stripper bars, or the sealing dies themselves are used for stripping by being partly closed for the stripping operation, then fully closed for sealing. Appropriate conventional means (not illustrated) is provided for operating the sealing dies at the desired intervals.

The web W is intermittently withdrawn from the supply roll R and fed through a dancer assembly 18 toward the forming shoulder 3 by a measuring axis, composed of a lower measuring roll 19 and an upper measuring roll 21. A servo motor 23 is used for intermittently driving the rolls 19 and 21 to the desired length for the packages P being formed by the apparatus 1. The web W travels from the measuring rolls 19 and 21, under a guide roll 25 and then up to and over the forming shoulder 3. The web W is pulled over the forming shoulder 3 under tension by a pair of pull belts 27 and 29 which press the film against the forming tube 13. The pull belt 27 is mounted about a pair of rollers 31, and the pull belt 29 is mounted about a pair of rollers 33. The pull belts 27 and 29 are driven by one or more servo motors 35 connected to the rollers 31 and 33.

The servo motors 23 and 35 are controlled by a controller 37 which may be a special purpose computer, or a general purpose computer which is programmed to perform the functions described in greater detail below. While the controller is shown only connected to the servo motors, obviously the controller would be used for other functions, such as monitoring the detection of an eye spot on the film and controlling closure of the sealing dies 17, and other related control and operator interface functions.

In operation, the web of film W is pulled from the roll R by the measuring rolls 19 and 21 for a predetermined film length (determined by the controller 37) in order to feed a desired length of film to the forming shoulder 3. The pull belts 27 and 29 pull the web W as it is formed into the film tube T by the forming shoulder 3. The controller 37 controls operation of both of the servo motors 23 and 35. Preferably, the servo motor 23 is operated as a master, and the servo motor 35 is operated as a slave. The master/slave relationship is controlled by the controller 37. Alternatively, instead of one motor 35, two motors could be used, one for the pull belt 27 and one for the pull belt 29.

In order to maintain correct tracking of the film over the forming shoulder 3 in the forward direction, it is desired to maintain tension in the web of film W as it passes over the forming shoulder 3. Thus, the master measuring rolls 19 and 21 are operated to convey the film tube an actual forward distance that is less than the forward distance that the slave pull belts 27 and 29 attempt to convey the film, with both forward distances being controlled by the controller 37. In one form of the invention, the forward distance attempted by the pull belts can be up to about 5 percent greater than the actual forward distance conveyed by the measuring rolls in order to maintain the web W taut.

It should be evident that with the pull belts 27 and 29 operating to attempt to convey the film tube T a greater forward distance than the measuring rolls 19 and 21 convey the film, if the film tube T were tightly held against the forming tube 13 by the pull belts 27 and 29, the plastic film of the tube T would be stretched by the pull belts. However, the film is not so tightly held as to be stretched, and instead the pull belts, by being driven a greater distance, actually permit the plastic film to slip relative to the pull belts. Thus, the pull belts maintain tension on the film and film tube, but do not unnecessarily stretch it as it is being conveyed.

Therefore, in order to maintain tension, it is only necessary that the pull belts be operated to attempt to convey the tube a forward distance which is greater than the forward distance through which the measuring rolls convey the film. Of course, the slippage between the pull belts and the film tube prevents stretching of the plastic film, but the greater surface distance through which the pull belts 27 and 29 are driven assures that tension is maintained in the forward direction. To achieve the greater distance, the pull belts 27 and 29 can be driven at greater surface velocities than the measuring rolls 19 and 21, during the same elapsed time. Alternatively, rather than having the pull belts 27 and 29 driven at a greater surface velocity than the measuring rolls 19 and 21, the pull belts 27 and 29 can be driven at the same surface velocity, but for a longer period of time.

To reverse the film pull direction, it is only necessary to reverse the direction of rotation of the measuring rolls 19 and 1 and the pull belts 27 and 29. Since the measuring rolls 19 and 21 are the master and the pull belts 27 and 29 are the slave, reversing the master also reverses the slave. However, if the ratio of the surface distance travelled by the pull belts 27 and 29 to the surface distance travelled by the rolls 19 and 21, or the time period of operation of the belts relative to the rolls, were maintained as in the forward direction, the web W would soon become slack between the forming tube 3 and the measuring rolls 19 and 21. Thus, when the direction is reversed, the measuring rolls 19 and 21 are operated to convey the film an actual reverse distance and the pull belts 27 and 29 are operated to attempt convey the tube a lesser reverse distance in order to always maintain tension in the web W between the forming tube 3 and the measuring rolls 19 and 21. Preferably, in the reverse direction, the surface distance travelled by the measuring rolls 19 and 21 is about the same percent greater than the surface distance travelled by the pull belts 27 and 29, resulting in tension in either direction. While it is preferred that the tension in the forward and reverse directions be equal, it can be unequal, so long as there is always tension in whichever direction the film is being conveyed. In the reverse mode of operation, excess film is generated between the measure rolls 19 and 21 and the film roll R. In order to maintain control of the excess film, the dancer take-up assembly 18 is used to take up the excess film generated during the reverse mode. In addition, it is beneficial if the film roll R can be stopped during the reversing operation. This is accomplished using the film brake 8. The brake 8 prevents the film roll R from continuing to rotate during the reversing operation, thus filling the dancer assembly 18 from the upstream and downstream sides simultaneously during the reverse operation.

As explained above in relation to film pull in the forward direction, maintenance of tension in the reverse direction results so long as the pull belts travel a lesser surface distance than the measuring rolls. In the same fashion, rather than stretching the film, there is slippage between the pull belts and the film tube in the reverse direction, while tension is maintained over the forming shoulder. While in the preferred form of the invention, the pull belts are driven at a lesser reverse surface velocity than that of the measuring rolls, their velocities can be the same, so long as the surface distance through which the pull belts travel in the reverse direction is no greater than that of the measuring rolls.

While in the preferred form of the invention as described above the pull belts 27 and 29 are reversed when the film pull direction is reversed, alternatively continuous motion pull belts, as set forth in U.S. Pat. No. 4,884,387, can be used instead. If this form of pull belt is used, when pull in the forward direction is intended to cease, the pull belts, which are continuously driven, are retracted from contact with the tube T, and therefore the tube is no longer pulled. In the reverse direction, the pull belts are not reengaged since they continue to be driven in the forward direction. Instead, the film is held against the metal tube 13 with one or more rubber tips which are located between the pull belts and the forming shoulder. Then, when the measuring rolls 19 and 21 are reversed, tension in the film is maintained since the rubber tips press the tube T against the forming tube 13 as the measuring rolls 19 and 21 are driven in the reverse direction. In the forward direction, the rubber tips are retracted and conveying of the film proceeds in precisely the manner described above.

In another form of the invention when using continuous motion pull belts, tension in the reverse direction can be provided by one or more small, rubber-tired pulleys which press the tube T against the forming tube 13. The pulleys are free to rotate when the tube T is conveyed in the forward direction, but have a slight dragging effect on the tube T in the reverse direction in order to provide tension in the film and the tube in the reversing process.

In another form of the invention, by disengaging the pull belts, reverse tension may be maintained without any additional hardware, depending on the film, product density, tube construction, stripper mechanism, etc. Resistance to the reverse pull is automatically generated by the weight of the product in the bag and the coefficient of friction between the film tube T and the forming tube 13 and may in most cases, provide sufficient drag to cause adequate tension in the film during the reverse pull.

The length of the film of the tube T is determined by the controller 37 in light of the positions of the measuring rolls 19 and 21 and the amount of film of the web W that has passed therethrough. If the film also includes an "eye spot" for determining the registration of preprinted film, that information is also fed to the controller 37 so that appropriate registration of the film is always accomplished.

The pull of the film in the forward direction is calculated based upon the ultimate package length desired, plus an extra length which is equal to the amount of reverse stripping. Thus, if the package length were 250 mm, and a stripping length of 50 mm is desired, the total film pull would be 300 mm. These parameters are all programmed in the controller 37. In addition, if the film has an eye spot for proper registration, the position of the eye spot is also programmed into the controller 37 so that proper registration of the film can always be maintained.

If in the forward direction there is a 5 percent greater surface distance travelled by the pull belts 27 and 29 in relation to the measuring rolls 19 and 21, for each one millimeter of surface travel of the measuring rolls, the pull belts must travel 1.05 mm. In the reverse direction, with the relationship reversed, the measuring rolls 19 and 21 would travel 1.00 mm and the pull belts 27 and 29 would respond with a move of 0.95 millimeter of surface travel.

Stripping of product and the sealing of the package P is accomplished in conjunction with closing of the sealing dies 17. For the fastest possible operation of the apparatus 1, it is desired that the closing of the sealing dies 17 be timed so that there is no interval between the time that movement of the tube T is halted, and the stripping begins.

Stripping is accomplished by activating the sealing system to partially close the sealing dies 17 on the tube T. The film is then pulled in the reverse direction and the tube is stripped in the sealing area. The tube is then sealed and severed into the finished package.

Instead of using the sealing dies for stripping, or in addition thereto, the tube can be shaken to settle injected product out of the sealing and severing area. For shaking, the measuring rolls 19 and 21 and the pull belts 27 and 29 are operated in the reverse direction to pull the tube a desired distance in the reverse direction. The measuring axis and the pull axis are then operated in the forward direction to return the tube that same desired distance. The forward and reverse operations are repeated a predetermined number of times with a predetermined number of frequency of repetition in order to settle the product into the partially finished package P. The number of times that the tube is shaken and the frequency of repetition is determined by the nature of the product introduced into the package P. Different products, such as granular material, require less settling than flaked products, such as potato chips.

It is to be noted that the shaking as described in the preceding paragraph is in the vertical direction. As explained above in the background portion of the invention, prior shaking or tapping of packages has been from side-to-side with additional apparatus.

In another form of settling of product by shaking, the measuring rolls 19 and 21 and the pull belts 27 and 29 transport the film W in the forward direction as described above. In the reverse direction, instead of reversing the pull belts 27 and 29, the servo motor 35 is de-energized, de-energizing power to the pull belts 27 and 29. Only the measuring rolls 19 and 21 are driven in the reverse direction. Although the tension in the film may vary from the forward direction to the reverse direction, drag imparted by the de-energized pull belts 27 and 29 and the film tube T on the forming tube 13 provides adequate tension on the film in the reverse direction.

In another form of settling of product by shaking, the measuring rolls 19 and 21 and the pull belts 27 and 29 are operated in the forward direction in the manner described above. In the reverse direction, the pull belts 27 and 29 are retracted from contact with the film tube T and only the measuring rolls 19 and 21 are reversed. Although tension in the film will vary from the forward direction to the reverse direction, drag imparted by the weight of the product in the partially formed package P and friction of the film tube T on the forming tube 13 provides an adequate tension in the film. If additional tension is required, rubber stops or rollers can be engaged with the film tube T during the reverse operation.

In a further form of settling of product, the film velocities in the forward and reverse directions can be adjusted to achieve a level of product settling. Since the forward movement of the film tube T must be stopped and then reversed, if the deceleration in the forward direction is adjusted to be rather gentle, the product falling inside the partially formed package P moves at a faster rate than the forward movement of the film tube T. In this manner, product is allowed to settle to the bottom of the partially formed package P. When the film is stopped and the direction is reversed, it can be advantageous to have a high rate of acceleration in the reverse direction in order to take advantage of the inertia of falling product as it continues its downward descent into the partially formed package P while the package is quickly reversed in the opposite direction. The actual rates of deceleration in the forward direction and acceleration in the reverse direction depend on the product being packaged within the package P, but do provide an effective product settling during the reversing and stripping operation. This has the advantage that stripping and settling occur simultaneously, thus improving the speed, and therefore the efficiency, of the apparatus 1.

In another form of settling of product, instead of shaking the partially finished package P, the measuring axis and pull axis are first operated in the forward direction for a desired distance, and then the measuring axis and the pull belt axis are reversed a distance less than the desired distance. These steps are repeated until the package P of desired length, with product therewithin, has been formed. The package P is then severed and sealed from the tube T.

In yet another form of the method, instead of reversing the measuring rolls 19 and 21 at all, the measuring rolls 19 and 21 and the pull belts 27 and 29 are operated in the forward direction to form a tube for a desired distance, and are then stopped. A portion of the desired product is then injected into the partially formed package T, and forward pulling is recommenced and then stopped again, and a second portion of the product is injected into the partially formed package. These steps are repeated until all of the desired product has been injected into the partially finished package, and the package is of a desired length. The sealing dies 17 are then closed, and the package P is severed and sealed from the tube T.

In yet another form of the process, an entire quantity of product can be injected into the partially finished package, and then the forward motion of the tube and film can be stopped and started a number of times to settle product within the partially formed package P. After the package P of desired length extends beneath the sealing dies 17, the dies are closed and the package is severed and sealed from the tube T.

Figure 2:
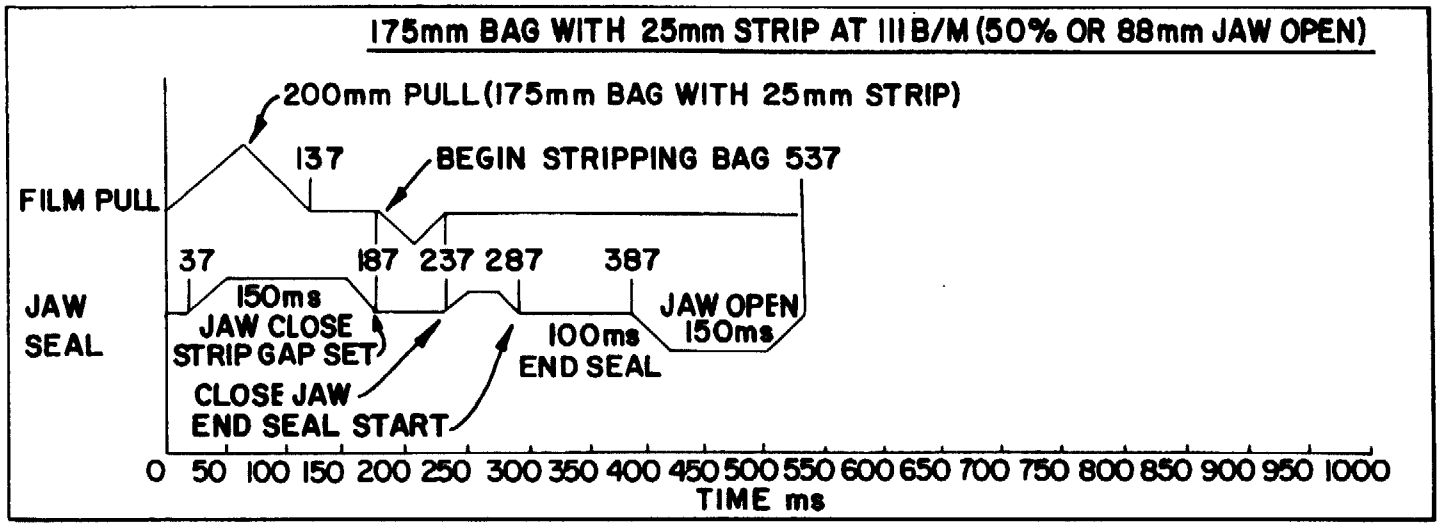
FIG. 2 shows a velocity profile of film pull and closing of the sealing and stripping jaws, in relation to time.

FIG. 2 illustrates one example of the film pull in relation to the sealing die positions in one form of the invention where a 175 mm long package is formed with a 25 mm stripping distance, when 111 bags are to be formed per minute. At time t=o, film pull begins and the sealing dies are at rest (and are fully opened sufficiently to allow the tube T to pass therebetween). Then, at 37 milliseconds, the sealing dies 17 begin to close and accelerate to a closing velocity. For 150 milliseconds, the sealing dies continue to close and then decelerate and stop in the partially closed condition at 187 milliseconds.

In the meantime, the film is pulled by the measuring rolls 19 and 21 until 200 mm has been pulled, 175 mm for the package length and 25 mm for stripping. The pulling ends at 137 milliseconds.

At 187 milliseconds, the partial closing of the sealing dies for stripping has been completed, and reverse pull of the web of film W is begun. This accelerates and decelerates to a stop at 237 milliseconds, at which time 25 mm of reverse stripping has occurred.

After the stripping, the sealing dies then completely close for another 50 milliseconds to clamp the tube T therebetween for sealing and severing. At 287 milliseconds, heat sealing and severing begins, and continues for 100 milliseconds. At the elapsed time of 387 milliseconds, the sealing and severing is completed and is terminated. The sealing dies 17 are then opened and retracted in the next 150 milliseconds, and the packaging cycle is completed. Thus, at an elapsed time of 537 milliseconds, the package P is fully formed, the sealing dies 17 have fully opened, and the process can be repeated for forming of a successive package P.

Figure 3:
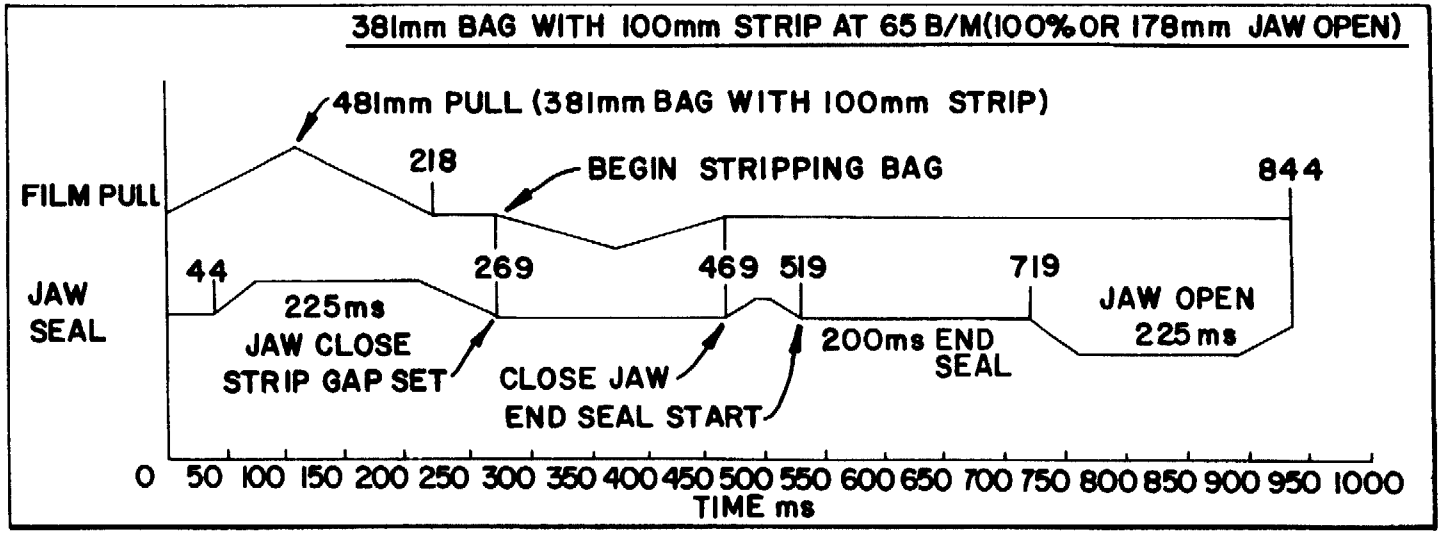
FIG. 3 shows a velocity profile similarly to FIG. 2, but for a longer running cycle for a larger package with a greater stripping length, longer sealing dwell time, and longer pull in the forward and reverse directions.

FIG. 3 illustrates the process explained in detail with respect to FIG. 2, but over a longer elapsed cycle for producing a larger package with a greater stripping distance, a longer sealing dwell time and a longer pulling time for the package. Otherwise, the sequence of events illustrated in FIG. 3 is identical to the sequence just described with relation to FIG. 2.

The apparatus 1 as described above can be a combination of conventional parts, such as elements of the incorporated references, or elements of the incorporated references in combination with parts of other references, such as U.S. Pat. No. 4,965,986 described above. However, the operation of those elements, and use of the elements for the unique stripping purposes described above to maintain tension in the web over the forming shoulder, is unique to this invention. By utilizing the measuring rolls and the pull belts for both the pulling operation and also the reverse stripping, extremely high package forming rates are achieved with controlled tension over the forming shoulder and precise registration of the packaging film.

Various changes can be made to the invention without the departing from the spirit thereof or scope of the following claims.

What is claimed is:

1. A method of maintaining tension on a flexible film as it passes in any direction over a forming shoulder of a vertical form, fill and seal machine, the machine including a source of film, a measuring axis for conveying the film and measuring a predetermined amount of the film, a forming shoulder for forming the film into a tube, a pull axis for conveying the tube, and a finishing system for sealing and severing successive packages from the tube into finished packages of desired lengths, the method comprising the steps of a. operating the measuring axis and the pull axis in a forward direction while pulling the film over the forming shoulder to form said tube and maintaining the tube in tension downstream of the forming shoulder to retain tension in the film as it passes over the forming shoulder in the forward direction, b. operating the measuring axis in a reverse direction while maintaining the tube in tension downstream of the forming shoulder to retain tension in the film as it passes over the forming shoulder in the reverse direction.

2. The method according to claim 1 including the step of controlling said axes in a master/slave relationship with one of said axes being a master and the other of said axes being a slave.

3. The method according to claim 2 in which said measuring axis is said master and said pull axis is said slave.

4. The method according to claim 1 in which said measuring axis is operated to convey the film an actual forward distance and the pull axis attempts to convey the film a forward distance greater than said actual forward distance.

5. The method according to claim 4 in which said attempted forward distance is up to about five percent greater than said actual forward distance.

6. The method according to claim 1 in which the step of holding said tube in tension downstream of the forming shoulder in the reverse direction comprises operating said measuring axis to convey the film an actual reverse distance and said pull axis attempts to convey the tube a reverse distance less than said actual reverse distance.

7. The method according to claim 6 in which said actual reverse distance is up to about five percent greater than said attempted reverse distance.

8. The method according to claim 1 including the step of stripping of the tube during method step "b".

9. The method according to claim 8 in which the step of stripping includes activating said finishing system before method step "b".

10. The method according to claim 9 in which said finishing system includes a pair of opposite sealing dies, and the step of activating said finishing system comprises partially closing said sealing dies before method step "b".

11. The method according to claim 1 including, before method step "b", the step of shaking the tube, comprising i. operating the measuring axis in the reverse direction for a desired distance while holding the tube in tension downstream of the forming shoulder to maintain tension in the film, ii. operating the measuring axis and the pull axis in the forward direction for said desired distance while holding the tube in tension, and iii. repeating "i" and "ii" a predetermined number of times with a predetermined frequency of repetition.

12. A method of maintaining tension on a flexible film as it passes in any direction over a forming shoulder of a vertical form, fill and seal machine and removing product that may be in a sealing and severing area of a package formed on the machine, the machine including a source of film, a measuring axis for conveying the film and measuring a predetermined amount of the film, a forming shoulder for forming the film into a tube, a pull axis for conveying the tube, and a finishing system for, sealing and severing successive packages from the tube into finished packages of desired lengths, the method comprising the steps of a. operating the measuring axis and the pull axis in a forward direction to form said tube for a desired distance, while pulling the film over the forming shoulder and retaining the tube in tension downstream of the forming shoulder to retain tension in the film as it passes over the forming shoulder in the forward direction, b. operating the measuring axis in a reverse direction to a distance less than said desired distance while maintaining the tube in tension downstream of the forming shoulder to retain tension in the film as it passes over the forming shoulder in the reverse direction, and c. repeating steps "a" and "b" until said tube is at least said desired length.

13. A method of maintaining tension on a flexible film as it passes in any direction over a forming shoulder of a vertical form, fill and seal machine and removing product that may be in a sealing and severing area of a package formed on the machine, the machine including a source of film, a measuring axis for conveying the film and measuring a predetermined amount of the film, a forming shoulder for forming the film into a tube, a pull axis for conveying the tube, and a finishing system for sealing and severing successive packages from the tube into finished packages of desired lengths, the method comprising the steps of a. operating the measuring axis and the pull axis in a forward direction to form said tube for a desired distance, while pulling the film over the forming shoulder and maintaining the tube in tension downstream of the forming shoulder to retain tension in the film as it passes over the forming shoulder in the forward direction, b. injecting a portion of a desired product into the tube, and c. repeating steps "a" and "b" until said tube is at least said desired length.

14. In a vertical form, fill and seal machine having a source of flexible film, a measuring axis for conveying the film and measuring a predetermined amount of film, a forming apparatus for forming the film into a tube and including a forming shoulder for forming the tube, a pull axis for conveying the tube, and a finishing system for sealing and severing successive finished packages of desired length from the tube, the improvement comprising means for maintaining tension in the film, including, a. means for operating the measuring axis and the pull axis in a forward direction, while pulling the film over the forming shoulder to form the tube and maintaining the tube in tension downstream of the forming shoulder to retain tension in the film as it passes over the forming shoulder in the forward direction, and b. means for operating the measuring axis in a reverse direction, and including means for maintaining said tube in tension downstream of the forming shoulder to retain tension in the film as it passes over the forming shoulder in the reverse direction.

15. A machine according to claim 14 in which said pull axis includes a pair of pull belts, and said means for operating the pull axis in a forward direction comprises a servo motor for driving said belts in synchronism and a controller connected to said servo motor.

16. A machine according to claim 14 in which said measuring axis includes a pair of measuring rolls, and said means for operating the measuring axis in a reverse direction comprises a servo motor for driving said measuring rolls and a controller connected to said servo motor.

17. A machine according to claim 16 in which said pull axis includes a pair of pull belts, and said means for operating the pull axis in a forward direction includes a second servo motor for driving said belts in synchronism, said controller being connected to said second servo motor.

18. A machine according to claim 17 in which said means for holding said tube in tension downstream of the forming shoulder comprises said pull belts.

19. A method of maintaining tension in a flexible film and removing any product that may be in a sealing and severing area of a package formed from the film in a vertical form, fill and seal machine, the machine including a source of the flexible film, a measuring axis for conveying the film and measuring a predetermined amount of film, a forming shoulder for forming the film into a tube, a pull axis for conveying the tube, and a finishing system for stripping, sealing and severing successive finished packages of desired length from the tube, the method comprising the steps of, a. operating the measuring axis and the pull axis in a forward direction to form the tube for a greater length than the desired length of the finished package, with said measuring axis operated to convey the film an actual forward distance and the pull axis operated to attempt to convey the film a formed distance greater than said actual forward distance, b. activating said finishing system to effect stripping of the tube, and c. operating the measuring axis and the pull axis in a reverse direction to strip product into the tube and produce a finished package of desired length with said measuring axis conveying the film an actual reverse distance and said pull axis attempting to convey the tube a lesser reverse distance.

20. The method of according to claim 19 including the step of controlling said axes in a master/slave relationship with one of said axes being a master and the other of said axes being a slave.

21. The method of according to claim 20 in which said measuring axis is said master and said pull axis is said slave.

22. The method according to claim 19 in which in the forward direction said measuring axis is operated at a forward surface velocity and said pull axis is operated at a greater forward surface velocity, and in the reverse direction said measuring axis is operated at a reverse surface velocity and said pull axis is operated at a lesser reverse surface velocity.

23. The method according to claim 22 in which the forward surface velocity of the pull axis and reverse surface velocity of the measuring axis are equal.

24. The method according to claim 19 in which the measuring axis is operated at first forward surface velocity and the pull axis is operated at second forward surface velocity which is up to about five percent greater than said first forward surface velocity.

25. The method according to claim 19 in which the measuring axis is operated at a first reverse surface velocity and the pull axis is operated at a second reverse surface velocity which is up to about five percent less than said first reverse surface velocity.

26. The method according to claim 19 in which method step "a" continues for a first predetermined period of time equal to time required for said measuring axis to convey film sufficient to form a tube of said greater length, and method step "c" continues for a second predetermined period of time equal to the time required to strip product into a partially finished package and form said finished package of desired length.

* * * * *